US005849470A

United States Patent [19]

Mydlarz et al.

[11] Patent Number: 5,849,470

[45] Date of Patent: Dec. 15, 1998

[54] MIXED GRAIN EMULSIONS OF THE SAME GRAINS HAVING DIFFERENT SPEED PROPERTIES FOR PHOTOGRAPHIC ELEMENTS

[75] Inventors: Jerzy Z. Mydlarz, Fairport; Frederick C. Derks; Roger L. Klaus, both of Rochester, all of N.Y.

[73] Assignee: Eastman Kodak Company, Rochester, N.Y.

[21] Appl. No.: 841,545

[22] Filed: Apr. 23, 1997

[51] Int. Cl.[6] ..... G03C 1/36; G03C 1/09

[52] U.S. Cl. ..... 430/509; 430/603; 430/606; 430/611

[58] Field of Search ..... 430/603, 606, 430/611, 509

[56] References Cited

U.S. PATENT DOCUMENTS

| | | | |
|---|---|---|---|
| 4,301,242 | 11/1981 | Patzold et al. | 430/569 |
| 4,362,806 | 12/1982 | Whitmore | 430/202 |
| 5,039,601 | 8/1991 | Ohya et al. | 430/569 |
| 5,219,721 | 6/1993 | Klaus et al. | 430/569 |
| 5,295,635 | 3/1994 | Niedospial, Jr. et al. | 242/74 |
| 5,360,712 | 11/1994 | Olm et al. | 430/567 |
| 5,418,118 | 5/1995 | Edwards et al. | 430/506 |
| 5,418,127 | 5/1995 | Budz et al. | 430/611 |
| 5,443,947 | 8/1995 | Lok | 430/569 |
| 5,457,021 | 10/1995 | Olm et al. | 430/567 |
| 5,462,849 | 10/1995 | Kuromoto et al. | 430/567 |

FOREIGN PATENT DOCUMENTS

| | | |
|---|---|---|
| 0 594 897 A1 | 10/1992 | European Pat. Off. . |
| 527521 | 2/1993 | European Pat. Off. . |
| 2-103032 | 4/1990 | Japan . |
| 2-198445 | 8/1990 | Japan . |
| 1 269 290 | 4/1972 | United Kingdom . |
| 2 134 271 | 8/1984 | United Kingdom . |

OTHER PUBLICATIONS

Research Disclosure, No. 38957, Sep. 1996, pp. 591–639.

*Primary Examiner*—Mark F. Huff
*Attorney, Agent, or Firm*—Paul A. Leipold

[57] ABSTRACT

The invention relates to a photographic element comprising at least two photographic emulsions wherein the grains of said at least two emulsions are the same and wherein at least one of said at least two emulsions is treated with a speed decreasing compound.

8 Claims, No Drawings

MIXED GRAIN EMULSIONS OF THE SAME GRAINS HAVING DIFFERENT SPEED PROPERTIES FOR PHOTOGRAPHIC ELEMENTS

FIELD OF THE INVENTION

This invention relates to photographic elements. It particularly relates to silver halide emulsions of different speed properties mixed in the same photographic layer or in layers of the same color record.

BACKGROUND OF THE INVENTION

There is a continuing need for methods to control the speed and curve shape of photographic emulsions. Typical methods for achieving slower emulsion records are utilizing smaller grain size emulsions, underfinishing, adding more sensitizing dyes, doping with metal complexes, or using filter dyes.

It has been known to control the properties of a photographic element by coating separate layers, belonging to the same color record, in so-called double-coat or triple-coat layers. These separate layers typically contain differently sized emulsions that have different sensitivities and different amount of chemicals such as sensitizing dyes, chemical sensitizers, or antifoggants. The imaging output of these individual layers can then be modulated by decreasing or increasing the level of imaging coupler copresent in the layer or by decreasing or increasing the level of inhibiting coupler copresent in the layer. The final effect of a double-coat or triple-coat color record is to achieve an overall latitude and improved curve shape relative to that achieved by a single emulsion in a single layer for a single color record.

It has also been known to control the properties of a photographic element by blending fast and slow emulsions in the same layer in a given color record.

The effect of blending emulsions has been to provide latitude and improved curve shape relative to a single emulsion. This is because the faster emulsion provides improved lower scale performance thereby providing better detail in the lower exposure region of the image. The slower emulsion provides improved higher scale performance thereby providing improved detail in the high density region of the photographic image. Sometimes a moderately sensitive emulsion is also utilized in a photographic element to improve detail in the middle density region of a photographic image.

Both of these techniques to obtain a color record or multiple color records in a photographic element are used to achieve greater exposure latitude and improved sensitometric characteristic curve shape not attainable by using only one emulsion of a given sensitivity in a given color record.

In order to form the faster and middle and slower emulsions, it has been necessary to utilize larger grains for the fast emulsions, smaller grains for the middle emulsions, and even smaller grains for the slower emulsions. When emulsions of these different sizes for a single color record are then blended into a single layer or are coated separately to form double-coat or triple-coat layers of differing speed, the smaller size emulsion having greater surface area requires a greater amount of dye for sensitization, as well as a greater amount of chemicals utilized for chemical sensitization and image formation, such as dye image-forming couplers. Further, in the manufacture of such elements, there are required a multiplicity of apparatus for forming the different size emulsions, their handling, and treatment prior to formation into photographic elements.

PROBLEM TO BE SOLVED BY THE INVENTION

There is a need to provide simplified photographic elements not requiring as many separate emulsions to be formed. There is also a need to lower the usage of other chemicals in the photographic elements.

SUMMARY OF THE INVENTION

An object of the invention is to overcome disadvantages of prior photographic elements.

Another object is to provide lower cost photographic elements.

A further object is to provide emulsions that are more stable during holding in manufacture prior to being formed into photographic elements.

These and other objects of the invention are accomplished by a photographic element comprising at least two photographic emulsions wherein the grains of said at least two emulsions are the same and wherein at least one of said at least two emulsions is treated with a speed decreasing compound.

Another embodiment of the invention is accomplished by a method of sensitization comprising forming an emulsion adding speed decreasing compound, adding chemical sensitizers and heating to sensitize wherein said speed decreasing compound is present in an amount to provide greater than 0.1 log E decrease in speed.

ADVANTAGEOUS EFFECT OF THE INVENTION

The invention provides lower cost manufacturing of photographic elements by simplifying manufacture of the emulsions utilized in the photographic elements, as well as requiring lower chemical use in the formation of the photographic elements.

DETAILED DESCRIPTION OF THE INVENTION

The invention provides numerous improvements over prior methods of photographic element manufacture and prior photographic elements. The method of the invention requires fewer emulsions in the manufacture of the photographic element, thereby decreasing the amount of equipment required to manufacture the emulsions for the photographic elements. The photographic elements of the invention require lower chemical usage such as chemical sensitizers, spectral sensitizers, and photographic couplers. The photographic elements of the invention utilizing fewer emulsions in a single color record provide for easier control of the curve shape and latitude of the elements. The photographic elements of the invention using less spectral sensitizing dye are less susceptible to staining, as there is less dye to wash out or decolorize during processing and less residual dye remaining after processing to develop images.

An advantage of utilizing the same emulsion adjusted to a different speed versus using separate emulsions in a single color record is that the emulsions have the same reciprocity characteristics and a change in the blend ratio of the faster and slower emulsions or amount in the double-coat or triple-coat layers does not change the reciprocity characteristics. In the prior photographic elements utilizing different emulsions in a single color record, each change of, for example, the blend ratio resulted in a change in the overall reciprocity of the photographic element. The prior techniques for changing emulsion properties included adding metal dopants or underfinishing by either using less chemical sensitizer in one emulsion or not heating to provide complete chemical sensitization. The invention also has the advantage that as each emulsion in the blend or in the double-coat or triple-coat has the same composition, including spectral sensitizer, the spectral sensitivity is the same for each emulsion regardless of the blend that is carried out to achieve a desired curve shape. A single color record means the emulsions are sensitized to the same color sensitivity; for example, all emulsions sensitized to red form the red color record for red exposure.

The phrase "same emulsion" indicates that the two emulsions have the identical composition, grain size, morphology, dispersity, and architecture. Grain composition refers to the silver halide composition, as well as the chemical composition of other materials added during grain formation such as dopants and ripeners. Grain architecture refers to structure elements such as bands of different compositions, and epitaxy. In some embodiments of the invention, the "same emulsion" will also have identical surface treatments such as spectral sensitization, antifoggant treatment, chemical sensitization, and reciprocity dopants. In other embodiments the "same emulsion" will be subjected to differing surface treatments where different amounts or compositions of spectral sensitizers may be utilized, different amounts and types of antifoggants may be utilized, and different amounts and types of reciprocity dopants may be utilized.

Any speed decreasing compound may be utilized in this invention that does not significantly affect the reciprocity, incubation and keeping characteristics, curve shape, developability, spectral sensitivity, and fog. The suitable compounds for this invention are those such as described in U.S. Pat. Nos. 5,219,721 and 5,418,127 and have the general structure:

$$R^1—X^1—X^2—R^2 \qquad \text{(Formula I)}$$

In the above formula $X^1$ and $X^2$ are independently S, Se, or Te; and $R^1$ and $R^2$, together with $X^1$ and $X^2$, form a ring system, or are independently substituted or unsubstituted cyclic, acyclic, or heterocyclic groups. Preferred is the combination of $X^1$ and $X^2$ being S atoms and $R^1$ and $R^2$ being substituted or unsubstituted alkyl or aryl groups. Specific examples of preferred combinations of $R^1$—$X^1$—$X^2$—$R^2$ are shown below.

EXAMPLES OF PREFERRED SPEED DECREASING COMPOUNDS

I-1

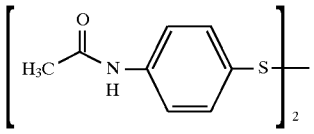

I-2

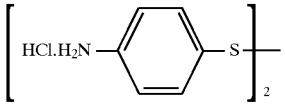

-continued

EXAMPLES OF PREFERRED SPEED DECREASING COMPOUNDS

I-3

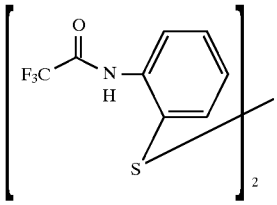

I-4

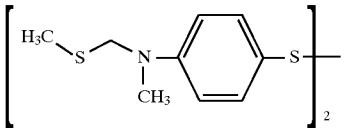

I-5

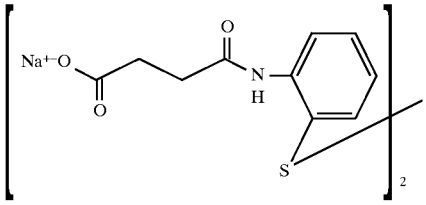

I-6

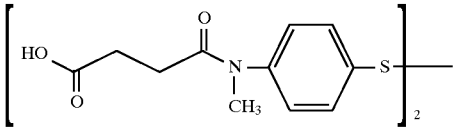

I-7

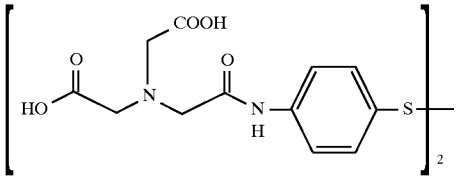

I-8

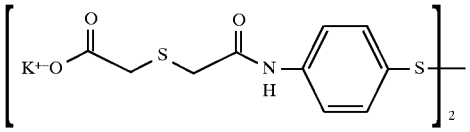

I-9

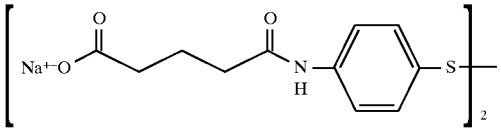

The speed decreasing compound may by utilized in any suitable amount. Generally the speed decreasing compound is use in an amount that will result in greater than 0.1 log E decrease in speed. In a preferred embodiment the decrease in speed will be between about 0.2 and 1.2 log E. It is preferred that the suitable compounds of the invention be added to the emulsion during the chemical finishing operations of chemical and spectral sensitization for best speed control.

The amount of speed decreasing compound utilized may be any amount. Typical is an amount of between about $1\times10^{-5}$ and about $1\times10^{-3}$ mol per silver mol. The preferred amount is between about $1\times10^{-4}$ and $1\times10^{-3}$ mol per silver mol when the preferred speed decreasing compound is Compound I–5. The preferred amount is between about $1\times10^{-5}$ and $5\times10^{-5}$ mol per silver mol when the preferred speed decreasing compound is Compound I–9. The specific preferred amount of speed decreasing compound will depend on the structure of the speed decreasing compound and on the nature of the silver halide emulsion acted on.

The emulsion of the invention are typically provided with melt hold stabilizing addenda during the coating operation.

Typical of such addenda are the soluble palladiun (II) complexes. Preferred are those such as the ethylenediamine complex of tetrachloropalladate.

The mixed grain emulsions of the invention may be utilized in any typical photographic element. These include color negative films, color paper utilizing negative emulsions, transparencies utilizing reversal imaging, and black-and-white films, especially duplitized x-ray recording films. The use in color negative films is preferred, as these films have more than one speed emulsion in a single color record. Such color negative films may have a slow speed, high speed, and medium speed emulsion in the same color record:

The emulsion grains in their preparation may be carried out by any of the known techniques in the art. Such techniques are disclosed in *Research Disclosure* No. 38957 of September 1996, at page 590–595

The grains of the invention may be sensitized both chemically and spectrally by any of the known techniques in the art. Typical of such techniques are those disclosed at *Research Disclosure* No. 38957 at Sections IV and V, pages 601–607.

It is further within the invention to adjust the properties of the grains by the use of antifoggant and stabilizer such as well known in the art. Such materials are those disclosed at *Research Disclosure* No.38957, Section VII at page 607–610. The photographic elements using the emulsions of the invention further may make use of any appropriate coating aids such as plasticizers, lubricants, antistats and matting agents such as disclosed at Section IX of *Research Disclosure* No. 38957, pages 612–616. As is apparent from the discussion above, the invention is primarily directed to the adjustment of properties by the use of a speed modifying compound to decrease the speed of at least one of the emulsions in a set. These emulsion sets are believed to find wide use among all silver halide photographic elements and with a variety of silver halide compositions.

The following examples illustrate the practice of this invention. They are not intended to be exhaustive of all possible variations of the invention. Parts and percentages are by weight unless otherwise indicated.

EXAMPLES

The following compounds are utilized in the Examples.

Compound A=Borane-tert-butylamine complex

Compound I–1=Bis(p-acetamidophenyl)disulfide

Sensitizing Dye A =

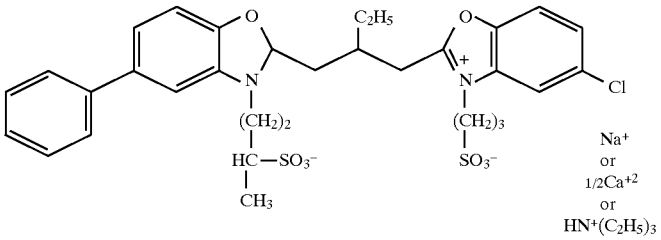

Sensitizing Dye B =

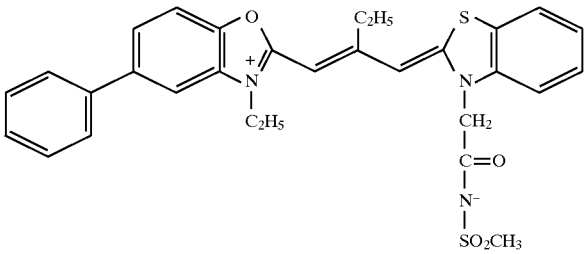

| | |
|---|---|
| Compound B = | Benzothiazolium, |
| | 5-6-dimethoxy-3-(3-sulfopropyl)-, inner salt |
| | Chemical Sensitizer A = Sodium aurous(I) dithiosulfate dihydrate |
| | Chemical Sensitizer B = Sodium thiosulfate pentahydrate |
| Compound C = | 4-Hydroxy-6-methyl-1,3,3a,7-tetraazaindene |
| Compound I-5 = | Bis(sodium o-succinamidophenyl)disulfide |

-continued
Compound D =
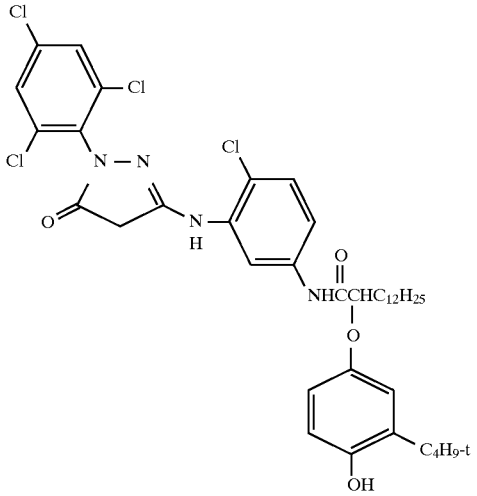
Compound E =
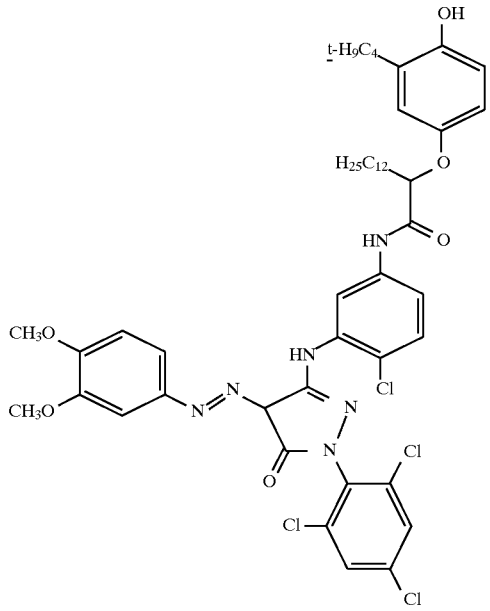
Compound F =
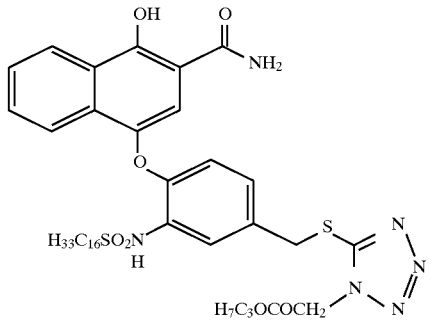
Compound G = Ethylenediamine complex of tetrachloropalladate
Compound H = Aurous sulfide -continued Compound J =

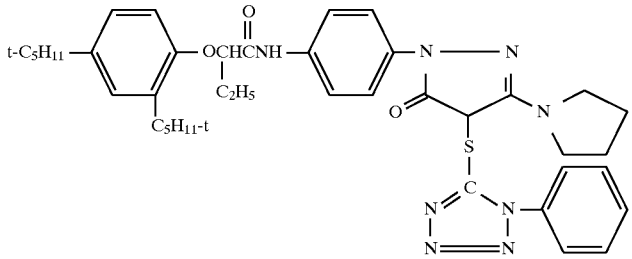

Compound I-9 = Bis(sodium p-glutaramidophenyl) disulfide

Sensitizing Dye C =

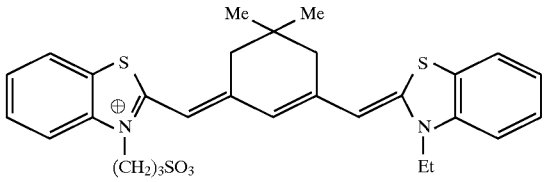

Example 1

A silver bromide tabular emulsion (Emulsion A) was precipitated according to Example 3 of U.S. Pat. No. 5,147,771 and treated with Compound A to obtain high sensitivity. The emulsion was then optimally sensitized with conventional sulfur and gold sensitization compounds.

Emulsion A-1 was prepared like Emulsion A except that mercuric chloride at a concentration of $1\times10^{-7}$ mol/silver mol was added before the sulfur and gold sensitizers.

Emulsion A-2 was prepared like Emulsion A except that mercuric chloride at a concentration of $5\times10^{-7}$ mol/silver mol was added before the sulfur and gold sensitizers.

Emulsion A-3 was prepared like Emulsion A except that Compound I–1 at a concentration of $1\times10^{-5}$ mol/silver mol was added before the sulfur and gold sensitizers.

Emulsion A-4 was prepared like Emulsion A except that Compound I–1 at a concentration of $5\times10^{-5}$ mol/silver mol was added before the sulfur and gold sensitizers.

The emulsions were then diluted with gelatin, water, and conventional coating surfactants and cast onto a blue-tinted cellulose acetate support. The emulsion layers were then hardened with an overcoat containing gelatin, water, conventional coating surfactants, and a vinylsulfone hardener. The resulting dried coatings were exposed for 0.02 seconds with 5500 K light through a graduated density tablet and developed in Kodak RP X-OMAT. Table I shows the shift in photographic sensitivity (as logE, measured at 0.3 density above D-min) relative to the untreated emulsion and the corresponding gradient (the straight-line portion of the characteristic curve, measured between 0.1 density above minimum developed density (D-min) and 0.1 density below maximum developed density (D-max)).

TABLE I

| Emulsion | Additive | mol/Ag mol | ΔlogE | Gradient |
|---|---|---|---|---|
| A | none | — | 0 | 0.288 |
| A-1 | $HgCl_2$ | $1\times10^{-7}$ | −0.52 | 0.335 |
| A-2 | $HgCl_2$ | $5\times10^{-7}$ | −0.69 | 0.332 |

TABLE I-continued

| Emulsion | Additive | mol/Ag mol | ΔlogE | Gradient |
|---|---|---|---|---|
| A-3 | Cpd I-1 | $1\times10^{-5}$ | −0.52 | 0.328 |
| A-4 | Cpd I-1 | $5\times10^{-5}$ | −0.69 | 0.365 |

These data show that the disulfide Compound I–1 of U.S. Pat. No. 5,219,721, when used at speed-decreasing levels in the finish, can induce similar large speed adjustments and gradient changes as the known environmentally undesirable dopant mercuric chloride.

Example 2

A silver bromo-iodide (3.3 mol % iodide) cubic monodisperse emulsion (Emulsion B, comparison) with 0.2 micrometer cubic edge length was treated in the following way (all materials added per mol silver halide). The pH of the liquid emulsion was adjusted to 6.0 and the pAg to 8.2 at 43.3° C. To the liquid emulsion was added 0.72 mmol of a solid-in-gelatin dispersion of Sensitizing Dye A, followed after 20 minutes by 0.18 mmol of a solid-in-gelatin dispersion of Sensitizing Dye B. After 10 minutes, 25 mg of Compound B was added. After 2 minutes, 12 mg of Chemical Sensitizer A and 6 mg of Chemical Sensitizer B were added. The liquid emulsion was then heated for 10 minutes at 70° C. and cooled back to 43.3° C., then 1.75 g of Compound C was added.

Example 3

A silver bromo-iodide (3 mol % iodide) cubic monodisperse emulsion (Emulsion C, comparison) with 0.113 micrometer cubic edge length was treated in the following way (all materials added per mol silver halide). The pH of the liquid emulsion was adjusted to 6.0 and the pAg to 8.2 at 43.3° C. To the liquid emulsion was added 0.88 mmol of a solid-in-gelatin dispersion of Sensitizing Dye A, followed after 20 minutes by 0.22 mmol of a solid-in-gelatin dispersion of Sensitizing Dye B. After 10 minutes, 25 mg of Compound B was added. After 2 minutes, 37 mg of Chemical Sensitizer A and 18.5 mg of Chemical Sensitizer B were added. The liquid emulsion was then heated for 5 minutes at 62.2° C. and cooled back to 43.3° C., then 1.75 g of Compound C was added.

Example 4

The following emulsions were variations of the process described in Example 2 (all materials added per mol silver halide).

Emulsion B 1 (invention) was prepared like Emulsion B of Example 2 except that $1\times10^{-4}$ mol of Compound I–5 was added to the liquid emulsion after pH and pAg adjustment but before the addition of the other sensitization components.

Emulsion B2 (invention) was prepared like Emulsion B of Example 2 except that $2.5\times10^{-4}$ mol of Compound I–5 was added to the liquid emulsion after pH and pAg adjustment but before the addition of the other sensitization components.

Emulsion B3 (invention) was prepared like Emulsion B of Example 2 except that $5\times10^{-4}$ mol of Compound I–5 was added to the liquid emulsion after pH and pAg adjustment but before the addition of the other sensitization components.

Emulsion B4 (invention) was prepared like Emulsion B of Example 2 except that $7.5\times10^{-4}$ mol of Compound I–5 was added to the liquid emulsion after pH and pAg adjustment but before the addition of the other sensitization components.

Emulsion B5 (invention) was prepared like Emulsion B of Example 2 except that $1\times10^{-3}$ mol of Compound I–5 was added to the liquid emulsion after pH and pAg adjustment but before the addition of the other sensitization components.

Emulsion D (comparison) was prepared like Emulsion B of Example 2 except that $8\times10^{-4}$ mol of Compound I–5 was added after the emulsion was sensitized.

COATING FORMULATION A, EXPOSURE, AND DEVELOPMENT

The emulsions of Examples 2–4 were separately mixed with additional gelatin and water in preparation for coating. Each emulsion was co-mixed with equal volumes of a melt of conventional gelatin-oil dispersions of Compound D, Compound E, and Compound F containing 1.75 g Compound C/silver mol, $4.5\times10^{-2}$ mol Compound G/silver mol, and 0.52 mg Compound H/silver mol. The cooled emulsion layer was protected by a gelatin overcoat containing conventional coating surfactants and hardened with bis (vinylsulfonylmethyl)ether.

The resulting coatings on cellulose triacetate support contained 807.3 mg silver/$m^2$, 4305.6 mg gelatin/$m^2$, 645.8 mg Compound D/$m^2$, 75.3 mg Compound E/$m^2$, and 21.5 mg Compound F/$m^2$.

After hardening, the dried coatings were exposed through a graduated density tablet using a 5500 K light source for 0.02 second, filtered with a Kodak Wratten 9 separation filter. The exposed coatings were processed for 3 minutes, 15 second in C-41 color negative process. The variation in photographic speed (logE) of all emulsions is measured at a density of 0.15 above minimum developed density and is relative to the photographic speed of the fastest emulsion.

TABLE II

| Emulsion | Compound I-5 (mol/Ag mol) | Condition | ΔlogE | Contrast | D-min | D-max |
|---|---|---|---|---|---|---|
| B | 0 | — | 0 | 3.28 | 0.31 | 2.85 |
| C | 0 | — | −0.78 | 3.63 | 0.18 | 2.88 |
| B1 | $1\times10^{-4}$ | During sensitization | −0.34 | 3.36 | 0.15 | 2.86 |
| B2 | $2.5\times10^{-4}$ | During sensitization | −0.49 | 3.49 | 0.15 | 2.87 |
| B3 | $5\times10^{-4}$ | During sensitization | −0.57 | 3.69 | 0.14 | 2.84 |
| B4 | $7.5\times10^{-4}$ | During sensitization | −0.69 | 3.85 | 0.14 | 2.88 |
| B5 | $1\times10^{-3}$ | During sensitization | −0.76 | 3.90 | 0.14 | 2.85 |
| D | $8\times10^{-4}$ | After sensitization | −0.09 | 3.25 | 0.23 | 2.82 |

The data of Table II show that the speed adjustment of the larger-grained emulsion can be matched relative to the smaller-grained emulsion by the use of an appropriate amount of Compound I–5 in the sensitization step without any significant deterioration in contrast or maximum developed density. This speed adjustment using Compound I–5 on the larger-grained emulsion can not be achieved when Compound I–5 is added after the sensitization step. The use of the inventive compounds in this manner also does not deleteriously affect the coated emulsion's latent image keeping properties.

Example 5

Emulsion B of Example 2 was blended with Emulsion C of Example 3 at a volume ratio of 1:2. In a separate operation, Emulsion B of Example 2 was similarly blended with Emulsion B5 of Example 4 at a volume ratio of 1:2. Half of these blended emulsions was prepared for coating using Coating Formula A and coated shortly after preparation. The other half of these blended emulsions was prepared for coating using Coating Formula A but was aged in a liquid state at 45° C. for 16 hours. The dried coatings were exposed and developed using the color process as described above. Minimum change in the sensitometric properties after melt aging reflects an increased stability of the liquid melt.

TABLE III

| Emulsion | Blend Ratio | Speed | Contrast | D-min | D-max | Δ Speed | Δ D-min | Δ Contrast | Δ D-max |
|---|---|---|---|---|---|---|---|---|---|
| B | 100% | 223 | 3.96 | 0.19 | 2.83 | −2 | 0.25 | −0.06 | 0 |
| C | 100% | 146 | 4.11 | 0.20 | 2.76 | 0 | 0.14 | −0.48 | −0.03 |
| B5 | 100% | 151 | 4.56 | 0.14 | 2.83 | 5 | 0.03 | −0.25 | 0 |
| B:C (comparison) | 1:2 | 197 | 2.97 | 0.24 | 2.70 | −9 | 0.11 | 0.06 | 0.05 |
| B:B5 (invention) | 1:2 | 192 | 3.78 | 0.20 | 2.84 | −3 | 0.07 | 0.11 | −0.01 |

The results in Table III show that a blend of emulsions with the same emulsion substrate gives similar speed position relative to a blend of emulsions with different emulsion substrates but with lower minimum density, higher contrast, and greater liquid melt stability. Exact sensitometric curve shape can be obtained by one skilled in the art by use of an appropriate speed decreasing amount of Compound I–5 and by using an appropriate blend ratio.

Example 6

Emulsion E (comparison) was prepared like Emulsion B of Example 2 except that after addition of the sensitization components the liquid emulsion was heated for minutes at 70° C. and cooled back to 40° C. followed by addition of 0.5 g of Compound C/Ag mol. Emulsion F (comparison) was prepared like Emulsion E except that 4 mg of Sensitizer A/silver mol and 2 mg of Sensitizer B/silver mol were added to the sensitization while maintaining the levels of the other sensitization components.

Coatings of Emulsions B5, C, E, and F were prepared as described in Coating Formulation A except that compound J was substituted for Compound E and Compound F. The level of Compound J in the final coatings was 21.5 mg/m$^2$. The dried coatings were exposed and developed using the color process as described above. The contrast of the sensitometric curve was calculated by the straight-line portion of the characteristic curve measured between 0.3 density above D-min and 0.2 density below D-max. The variation in photographic speed (logE) of all emulsions is measured at a density of 0.15 above minimum developed density and is relative to the photographic speed of the fastest emulsion.

TABLE IV

| Emulsion | ΔlogE | Contrast | D-min | D-max |
|---|---|---|---|---|
| E | 0 | 1.40 | 0.18 | 2.46 |
| F | −0.33 | 1.28 | 0.24 | 2.35 |
| C | −0.65 | 1.96 | 0.13 | 2.40 |
| B5 | −0.56 | 1.94 | 0.10 | 2.39 |

The data in Table IV show that even though underfinishing the larger-grain emulsion gives only half the desired speed adjustment relative to the smaller-grain emulsion, there is also a large deterioration in the contrast maximum density, and minimum density. Such deterioration is absent when a speed-decreasing amount of Compound I–5 is applied to the larger-grain emulsion to give the desired speed adjustment.

Example 7

Emulsion G

This emulsion demonstrates the conventional cubic emulsion precipitated in oxidized gelatin and doped with Compound I–9 for fresh fog control; 6 μg osmium/Ag mole (for contrast control); and with 0.04 mg iridium/Ag mole for reciprocity control.

A pure chloride silver halide emulsion was precipitated by equimolar addition of silver nitrate and sodium chloride into a well stirred reactor containing gelatin peptizer.

A reaction vessel contained 4.5 L of a solution that was 7.9% in oxidized gelatin, 0.038M in NaCl. The contents of the reaction vessel were maintained at 55° C. and the pCl was adjusted to 1.7. To this stirred solution at 55° C. 27.7 mL of a solution 2.6M in $AgNO_3$ and 26.9 mL of a solution 2.8M in NaCl were added simultaneously at 27.7 mL/min for 1 minute.

The 2.6M silver nitrate solution and the 2.8M sodium chloride solution were added simultaneously with a ramped linearly increasing flow from 27.7 mL/min to 123 mL/min over 20 minutes. The 2.6M silver nitrate solution and 2.8M sodium chloride solution were then added simultaneously at 123 mL/min for 40 minutes. The emulsion was cooled down to 40° C. over 5 minutes. The resulting emulsion was a cubic grain silver chloride emulsion of 0.4 μm in edgelength size. The emulsion was then washed using an ultrafiltration unit, and final pH and pCl were adjusted to 5.6 and 1.7 respectively.

Emulsion H

Same as Emulsion G except that emulsion was doped with 10 μg of osmium/Ag mole.

Emulsion I

Same as Emulsion H except that 1 mg of Compound I–9/Ag mole was added to the silver nitrate solution.

Emulsion J

Same as Emulsion H except that 2 mg of Compound I–9/Ag mole was added to the silver nitrate solution.

Emulsion K

Same as Emulsion H except that 4 mg of Compound I–9/Ag mole was added to the silver nitrate solution.

Emulsion L

Same as Emulsion G except that emulsion was doped with 0.0385 mg of iridium/Ag mole.

Example 8

Emulsion M

This emulsion demonstrates the conventional cubic emulsion precipitated in regular gelatin and doped with ruthenium.

A pure chloride silver halide emulsion was precipitated by equimolar addition of silver nitrate and sodium chloride into a well stirred reactor containing gelatin peptizer.

A reaction vessel contained 5.0 L of a solution that was 3.9% in regular gelatin, 0.0257M in NaCl. The contents of the reaction vessel were maintained at 55° C. and the pCl was adjusted to 1.7. To this stirred solution at 55° C. 18 mL of a solution 4.0M in $AgNO_3$ and 18 mL of a solution 4M in NaCl were added simultaneously at 18 mL/min for 1 minute. The the 4.0M silver nitrate solution and the 4.0M sodium chloride solution were added simultaneously with a ramped linearly increasing flow from 18 mL/min to 80 mL/min over 20 minutes. The 4.0M silver nitrate solution and 4.0M sodium chloride solution were then added simultaneously at 80 mL/min for 20 minutes. During precipitation, 25 mg of $K_4Ru(CN)_6$ per mole of silver was added. The ruthenium component was uniformly distributed from 80 to 85 % of the make. Then emulsion was cooled down to 40° C. over 5 minutes. The resulting emulsion was a cubic grain silver chloride emulsion of 0.4 μm in edgelength size. The emulsion was then washed using an ultrafiltration unit, and final pH and pCl were adjusted to 5.6 and 1.7 respectively.

Emulsion N

Same as Emulsion G of Example 7 except that emulsion was doped with 3 μg of osmium/Ag mole and 0.05 mg iridium/Ag mole Emulsion O Same as Emulsion N except that emulsion was doped with 5.2 mg of Compound I–9/Ag mole.

Emulsion P

Same as Emulsion N except that emulsion was doped with 10.4 mg of Compound I–9/Ag mole.

Emulsion R

Same as Emulsion N except that emulsion was doped with 20.8 mg of Compound I–9/Ag mole.

Emulsion S

Same as Emulsion N except that emulsion was doped with 4.65 mg of Compound I–9/Ag mole.

Emulsion T

Same as Emulsion N except that emulsion was doped in the finish with 8 mg of Compound I–9/Ag mole.

SENSITIZATION, COATING FORMULATION, EXPOSURE, AND DEVELOPMENT

The emulsions were optimally sensitized by the customary techniques known in the art. In each finish where used, Compound I–9 was added prior to both chemical or spectral sensitization. Detailed procedures are described below for emulsions of Examples 9–14.

In magenta-sensitized emulsions Sensitizing Dye A was used.

Just prior to coating on resin coated paper support magenta-sensitized emulsions were mixed with magenta dye forming coupler dispersion containing Coupler A.

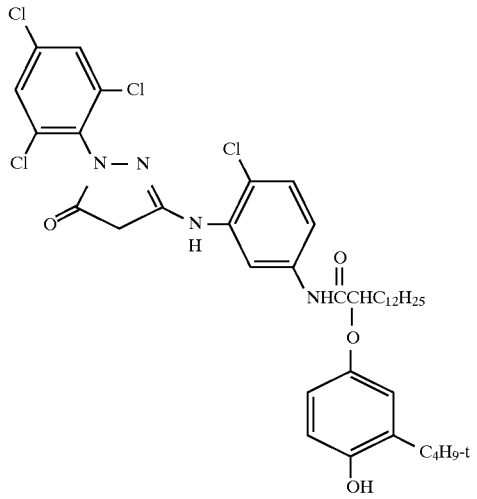

In cyan-sensitized emulsions Sensitizing Dye C was used.

Just prior to coating on resin coated paper support cyan-sensitized emulsions were mixed with cyan dye forming coupler dispersion containing Coupler B.

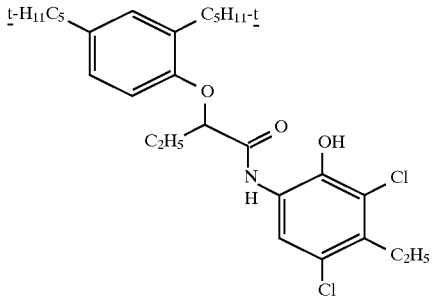

The magenta-sensitized emulsions were coated at 26 mg silver per square foot while the cyan sensitized emulsions were coated at 17 mg silver per square foot on resin-coated paper support. The coatings were overcoated with a gelatin layer and the entire coating was hardened with bis (vinylsulfonylmethyl)ether.

Coatings were exposed through a step wedge with a 3000 K tungsten light source at an exposure time of 0.10 second.

All coatings were developed in Process RA-4.

Example 9

This example compares silver chloride cubic emulsions precipitated in oxidized gelatin and doped with Compound I–9, osmium and iridium during precipitation, and sensitized for magenta color record. The sensitization details were as follows:

Part 9.1: A portion of silver chloride Emulsion G was optimally sensitized by the addition of the optimum amount of green Sensitizing Dye A followed by addition of the optimum amount of sulfur and gold compounds. The emulsion was heated up to 60° C. for 45 minutes, and then was cooled down to 40° C. and 1-(3-acetamidophenyl)-5 -mercaptotetrazole was added followed by addition of soluble potassium bromide.

Part 9.2: A portion of silver chloride Emulsion G was sensitized identically as in Part 9.1 except that 5 mg of Compound I–9/Ag mole was added as the first addendum in the finish.

Part 9.3: A portion of silver chloride Emulsion G was sensitized identically as in Part 9.1 except that 20 mg of Compound I–9/Ag mole was added as the first addendum in the finish.

Sensitometric data are summarized in Table V.

TABLE V

| Emulsion Finish | mg Compound I-9/Ag mole | Speed @ D = 1.0 | $D_{min}$ | Toe | Shoulder | Contrast | Speed @ Dmin + 0.75 $10^{-2}$ s | Speed @ Dmin + 0.75 $10^{-4}$ s |
|---|---|---|---|---|---|---|---|---|
| Part 9.1 | 0 | 175 | 0.12 | 0.41 | 1.68 | 2.225 | 191 | 190 |
| Part 9.2 | 5 | 144 | 0.11 | 0.49 | 1.54 | 1.653 | 154 | 146 |
| Part 9.3 | 20 | 102 | 0.11 | 0.49 | 1.59 | 1.803 | 102 | 96 |

Sulfur and gold sensitized silver chloride cubic emulsions made in oxidized gelatin exhibit the desired effect of Compound I–9 when added during sensitization in the magenta finish format. Larger losses of speed due to the presence of Compound I–9 in the finish are observed without causing substantial changes in reciprocity and in characteristic curve shape.

Example 10

This example compares silver chloride cubic emulsions precipitated in oxidized gelatin and doped with Compound I–9, osmium and iridium during precipitation, and sensitized with sulfur and gold compounds for magenta color record. The sensitization details were as follows:

Part 10.1: A portion of silver chloride Emulsion H was optimally sensitized by the addition of the optimum amount of green Sensitizing Dye A followed by addition of the optimum amount of sulfur and followed by optimum amount of gold(I). The emulsion was heated up to 60° C. for 45 minutes. Then emulsion was cooled down to 40° C. and 1-(3-acetamidophenyl)-5-mercaptotetrazole was added followed by addition of soluble potassium bromide.

Part 10.2: A portion of silver chloride Emulsion I was sensitized identically as in Part 10.1.

Part 10.3: A portion of silver chloride Emulsion J was sensitized identically as in Part 10.1.

Part 10.4: A portion of silver chloride Emulsion K was sensitized identically as in Part 10.1.

Sensitometric data are summarized in Table VI

TABLE VI

| Emulsion | mg Compound | Speed @ | | | | | Speed @ Dmin + 0.75 | |
|---|---|---|---|---|---|---|---|---|
| Finish | I-9/Ag mole | D = 1.0 | $D_{min}$ | Toe | Shoulder | Contrast | $10^{-2}$ s | $10^{-4}$ s |
| Part 10.1 | 0 | 167 | 0.130 | 0.239 | 2.187 | 2.53 | 163 | 161 |
| Part 10.2 | 1 | 161 | 0.123 | 0.240 | 2.227 | 2.53 | 158 | 159 |
| Part 10.3 | 2 | 159 | 0.119 | 0.248 | 2.104 | 2.50 | 159 | 162 |
| Part 10.4 | 4 | 152 | 0.117 | 0.245 | 2.048 | 2.51 | 154 | 156 |

Sulfur and gold sensitized silver chloride cubic emulsions made in oxidized gelatin exhibit the desired effect of Compound I–9 when added during precipitation when sensitized in the magenta finish format. Larger losses of speed due to the presence of Compound I–9 in the precipitation are observed without causing substantial changes in reciprocity and in characteristic curve shape.

Examples 11

This example compares silver chloride cubic emulsions precipitated in oxidized gelatin and doped with osmium and iridium during precipitation and sensitized for magenta color record. The sensitization details were as follows:

Part 11.1: A portion of silver chloride Emulsion L was optimally sensitized by the addition of the optimum amount of green Sensitizing Dye A followed by addition of the optimum amount of colloidal gold-sulfide. The emulsion was heated up to 60° C. for 45 minutes. Then emulsion was cooled down to 40° C. and 1-(3-acetamidophenyl)-5-mercaptotetrazole was added followed by addition of soluble potassium bromide.

Part 11.2: A portion of silver chloride Emulsion L was sensitized identically as in Part 11.1 except that 5 mg of Compound I–9/Ag mole was added as the first addendum in the finish.

Part 11.3: A portion of silver chloride Emulsion L was sensitized identically as in Part 11.1 except that 10 mg of Compound I–9/Ag mole was added as the first addendum in the finish.

Part 11.4: A portion of silver chloride Emulsion L was sensitized identically as in Part 11.1 except that 20 mg of Compound I–9/Ag mole was added as the first addendum in the finish.

Sensitometric data are summarized in Table VII.

TABLE VII

| Emulsion | mg Compound | Speed @ | | | | | Speed @ Dmin + 0.75 | |
|---|---|---|---|---|---|---|---|---|
| Finish | I-9/Ag mole | D = 1.0 | $D_{min}$ | Toe | Shoulder | Contrast | $10^{-2}$ s | $10^{-4}$ s |
| Part 11.1 | 0 | 187 | 0.134 | 0.310 | 2.218 | 2.29 | 192 | 197 |
| Part 11.2 | 5 | 176 | 0.138 | 0.311 | 2.270 | 2.31 | 181 | 184 |
| Part 11.3 | 10 | 163 | 0.138 | 0.309 | 2.335 | 2.31 | 168 | 172 |
| Part 11.4 | 20 | 156 | 0.138 | 0.308 | 2.340 | 2.31 | 149 | 151 |

Gold-sulfide sensitized silver chloride cubic emulsions made in oxidized gelatin exhibit the desired effect of Compound I–9 when added during sensitization in the magenta finish format. Larger losses of speed due to the presence of Compound I–9 in the finish are observed without causing substantial changes in reciprocity and in characteristic curve shape.

Example 12

This example compares silver chloride cubic emulsions made in regular gelatin and doped with ruthenium during precipitation and sensitized for cyan color record. The sensitization details were as follows:

Part 12.1: A portion of silver chloride Emulsion M was optimally sensitized by the addition of the optimum amount of a stilbene compound followed by addition of the optimum amount of sulfur followed by addition of the optimum amount of gold(I). The emulsion was heated up to 60° C. and held for 30 minutes, and then 1-(3-acetamidophenyl)-5-mercaptotetrazole was added, followed by addition of iridium, followed by addition of Lippmann silver bromide followed by addition of cyan Sensitizing Dye C.

Part 12.2: A portion of silver chloride Emulsion M was sensitized identically as in Part 12.1 except that 1 mg of Compound I–9/Ag mole was added as the first addendum in the finish.

Part 12.3: A portion of silver chloride Emulsion M was sensitized identically as in Part 12.1 except that 2 mg of Compound I–9/Ag mole was added as the first addendum in the finish.

Part 12.4: A portion of silver chloride Emulsion M was sensitized identically as in Part 12.1 except that 3 mg of Compound I–9/Ag mole was added as the first addendum in the finish.

Sensitometric data are summarized in Table VIII.

TABLE VIII

| Emulsion Finish | mg Compound I-9/Ag mole | Speed @ D = 1.0 | $D_{min}$ | Toe | Shoulder | Contrast | Speed @ Dmin + 0.75 $10^{-2}$ s | Speed @ Dmin + 0.75 $10^{-4}$ s |
|---|---|---|---|---|---|---|---|---|
| Part 12.1 | 0 | 226 | 0.169 | 0.27 | 1.99 | 2.947 | 165 | 155 |
| Part 12.2 | 1 | 217 | 0.118 | 0.19 | 2.17 | 3.556 | 159 | 145 |
| Part 12.3 | 2 | 207 | 0.102 | 0.17 | 2.19 | 3.599 | 153 | 152 |
| Part 12.4 | 3 | 181 | 0.102 | 0.18 | 2.14 | 3.455 | 129 | 132 |

Presence of Compound I–9 in the sulfur-plus-gold sensitized cyan finish format of silver chloride cubic emulsion precipitated in regular gelatin significantly desensitizes the emulsion without changing reciprocity and characteristic curve shape.

Example 13

This example compares silver chloride cubic emulsions made in oxidized gelatin and doped with Compound I–9, osmium and iridium during precipitation, and sensitized for cyan color record. The sensitization details were as follows:

Part 13.1: A portion of silver chloride Emulsion N was sensitized identically as in Part 12.1.

Part 13.2: A portion of silver chloride Emulsion O was sensitized identically as in Part 12.1.

Part 13.3: A portion of silver chloride Emulsion P was sensitized identically as in Part 12.1.

Part 13.4: A portion of silver chloride Emulsion R was sensitized identically as in Part 12.1.

Sensitometric data are summarized in Table IX

TABLE IX

| Emulsion Finish | mg Compound I-9/Ag mole | Speed @ D = 1.0 | $D_{min}$ | Toe | Shoulder | Contrast | Speed @ Dmin + 0.75 $10^{-2}$ s | Speed @ Dmin + 0.75 $10^{-4}$ s |
|---|---|---|---|---|---|---|---|---|
| Part 13.1 | 0 | 203 | 0.290 | 0.55 | 1.81 | 2.603 | 137 | 136 |
| Part 13.2 | 5.2 | 170 | 0.123 | 0.40 | 1.94 | 2.911 | 112 | 117 |
| Part 13.3 | 10.4 | 156 | 0.112 | 0.39 | 1.94 | 2.967 | 106 | 107 |
| Part 13.4 | 20.8 | 134 | 0.110 | 0.41 | 1.82 | 2.954 | 85 | 90 |

Sulfur-plus-gold sensitized silver chloride cubic emulsions made in oxidized gelatin exhibit the desired effect of Compound I–9 when added during precipitation when sensitized in the cyan finish format. Larger losses of speed due to the presence of Compound I–9 in the precipitation are observed without causing substantial changes in reciprocity and in characteristic curve shape.

Example 14

This example shows blending of silver chloride cubic emulsion made in oxidized gelatin (faster component) with silver chloride cubic emulsion made in oxidized gelatin and doped with 8 mg of Compound I–9/Ag mole (slower component). The sensitization details were as follows:

Part 14.1: A portion of silver chloride Emulsion S (faster component) was sensitized identically as in Part 9.1.

Part 14.2: A 90% of silver chloride Emulsion S was sensitized identically as in Part 9.1 was blended with 10% of silver chloride Emulsion T sensitized identically as in Part 9.1.

Part 14.2: A 60% of silver chloride Emulsion S was sensitized identically as in Part 9.1 was blended with 40% of silver chloride Emulsion T sensitized identically as in Part 9.1.

Part 14.3: A 30% of silver chloride Emulsion S was sensitized identically as in Part 9.1 was blended with 70% of silver chloride Emulsion T sensitized identically as in Part 9.1.

Part 14.4: A 10% of silver chloride Emulsion S was sensitized identically as in Part 9.1 was blended with 90% of silver chloride Emulsion T sensitized identically as in Part 9.1.

Part 14.5: A portion of silver chloride Emulsion T (slower component) was sensitized identically as in Part 9.1.

Sensitometric data are summarized in Table X

TABLE X

| Emulsion | % Component | Speed @ | | | | | Speed @ Dmin + 0.75 | |
|---|---|---|---|---|---|---|---|---|
| Finish | Fast:Slow | D = 1.0 | $D_{min}$ | Toe | Shoulder | Contrast | $10^{-2}$ s | $10^{-4}$ s |
| Part 14.1 | 100:0 | 164 | 0.134 | 0.37 | 1.85 | 2.714 | 168 | 166 |
| Part 14.2 | 90:10 | 161 | 0.130 | 0.35 | 1.86 | 2.728 | 166 | 165 |
| Part 14.3 | 60:40 | 151 | 0.124 | 0.43 | 1.76 | 2.337 | 157 | 153 |
| Part 14.4 | 30:70 | 127 | 0.120 | 0.39 | 1.68 | 2.285 | 135 | 128 |
| Part 14.5 | 10:90 | 108 | 0.120 | 0.44 | 1.72 | 2.013 | 109 | 93 |
| ParL 14.6 | 0:100 | 103 | 0.120 | 0.46 | 1.78 | 2.114 | 105 | 91 |

The results in Table X show that the blends of fast and slow emulsions give similar characteristic curve shape and reciprocity but significantly different speed positions as a function of blend ratio.

Example 15

A tabular silver iodobromide (1.85 mol % iodide) emulsion (Emulsion U, comparison) as described in Fenton et al., U.S. Pat. No. 5,476,760 with equivalent circular diameter of 0.49 micrometer and thickness of 0.12 micrometer was treated in the following way (all materials added per mol silver halide). To the liquid emulsion at 43.3° C. was added 120 mg potassium thiocyanate, followed after 5 minutes by 0.8 mmol of a solid-in-gelatin dispersion of Sensitizing Dye A, followed after 20 minutes by 0.2 mmol of a solid-in-gelatin dispersion of Sensitizing Dye B. After 20 minutes, 10 mg of Chemical Sensitizer A, 5 mg of Chemical Sensitizer B, and 45 mg of 3 -(2-methylsulfamoylethyl)-benzothiazolium tetrafluoroborate were added. The liquid emulsion was then heated for 5minutes at 68° C. and then cooled back to 40° C. Emulsion U-1 (invention) was prepared like Emulsion U, except that $7.5\times10^{-4}$ mol of Compound I–5 was added to the liquid emulsion before the addition of the other sensitization components.

Coatings of Emulsion U, Emulsion U-1, and Emulsion C were prepared as described in Example 6. After hardening, the dried coatings were exposed through a graduated density tablet using a 5500 K light source for 0.02 second, filtered with a Kodak Wratten 9 separation filter. The exposed coatings were processed for 3 minutes, 15 second in C-41 color negative process. The variation in photographic speed (logE) of all emulsions is measured at a density of 0.15 above minimum developed density and is relative to the photographic speed of the fastest emulsion.

TABLE XI

| Emulsion | ΔlogE | Contrast | D-min | D-max |
|---|---|---|---|---|
| U | 0 | 3.29 | 0.17 | 2.57 |
| C | −0.87 | 3.81 | 0.15 | 2.59 |
| U-1 | −0.79 | 3.03 | 0.13 | 2.53 |

The data of Table XI show that a faster tabular emulsion can be modified by the use of Compound I–5 in the sensitization to give characteristic curve shape similar to a finer-grained, slower cubic emulsion. This desired speed adjustment is obtained without significant deterioration in maximum developed density. Additional co-optimization with Compound I–5 and other sensitization components by those skilled in the art has shown that higher or lower contrast can be obtained while maintaining desired A logE, low D-min and high D-max.

The invention has been described in detail with particular reference to preferred embodiments thereof, but it will be understood that variations and modifications can be effected within the spirit and scope of the invention.

We claim:

1. A photographic element comprising at least two negative working photographic emulsions wherein said at least two emulsions are the same emulsion and wherein at least one of said at least two same emulsions is treated with a speed decreasing compound wherein said speed decreasing compound is the compound $$R^1—X^1—X^2—R^2 \quad \text{(Formula I)}$$

wherein $X^1$ and $X^2$ are independently S, Se, or Te, and $R^1$ and $R_2$ together form a ring system or are independently substituted or unsubstituted cyclic, acyclic, or heterocyclic groups and wherein said element comprises negative film and after treating at least one of said same emulsions has a different sensitivity.

2. The element of claim 1 wherein said speed decreasing compound comprises greater than $5\times10^{-5}$ mol per mol of silver.

3. The element of claim 1 wherein said speed decreasing compound comprises greater than $1\times10^{-4}$ mol per mol of silver.

4. The photographic element of claim 1 wherein said at least two emulsions have a COV of less than 10 percent.

5. The element of claim 1 wherein said speed decreasing compound is a disulfide compound represented by Formula II:

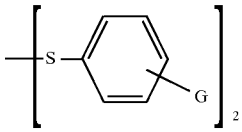

(Formula II)

where G is independently in an ortho, meta, or para position on the aromatic nucleus relative to the sulfur and is hydrogen, hydroxy, $SO_3M$ or $NR^3R^4$;

M is hydrogen, or an alkaline earth, alkylammonium or arylammonium cation;

$R^3$ is hydrogen, or a substituted or unsubstituted alkyl or aryl group;

$R^4$ is hydrogen, O═C—$R^5$, or O═C—N—$R^6R^7$; and $R^5$, $R^6$, and $R^7$ are independently hydrogen, or hydroxy, or an unsubstituted alkyl, or aryl group, or a substituted or unsubstituted fluoroalkyl, fluoroaryl, carboxyalkyl, carboxyaryl, alkythioether, arylthioether, sulfoalkyl, or sulfoaryl group or the free acid, alkaline earth salt or alkylammonium or arylammonium salt of the aforementioned groups.

6. The element of claim 5 wherein the disulfide is represented by Formula II and the molecule is symmetrical and G is in an ortho, meta, or para position on the aromatic nucleus relative to the sulfur and is $NR^3R^4$; and $R^4$ is hydrogen or O═C—$R^5$.

7. The element of claim 5 wherein G is in an ortho or para position on the aromatic nucleus relative to the sulfur, $R^3$ is hydrogen or methyl, $R^4$ is O═C—$R^5$, and $R^5$ is an alkyl group of 1 to 6 carbon atoms or a carboxyalkyl group of 2 to 6 carbon atoms.

8. The element of claim 1 wherein said at least two emulsions are in the same color record.

* * * * *